US005551865A

United States Patent [19]

Henderson et al.

[11] Patent Number: 5,551,865

[45] Date of Patent: Sep. 3, 1996

[54] SAFETY SHUT-OFF DEVICE FOR LIQUID FUEL BURNERS

[76] Inventors: Richard W. Henderson, 1820 Stricklen, Florence, S.C. 29505; Samuel R. Henderson, 2976 Hwy. 112, DeRidder, La. 70634

[21] Appl. No.: 559,922

[22] Filed: Nov. 17, 1995

[51] Int. Cl.[6] ..... F23N 5/00

[52] U.S. Cl. ..... 431/33; 431/34; 431/65

[58] Field of Search ..... 431/33, 34, 39, 431/65

[56] References Cited

U.S. PATENT DOCUMENTS

| | | | |
|---|---|---|---|
| 1,392,187 | 9/1921 | Mahan | 137/405 |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 2,165,162 | 7/1939 | Thornton | 431/117 |
| 3,169,519 | 2/1965 | Aizawa . | |
| 3,501,252 | 3/1970 | Richardson . | |
| 4,363,620 | 12/1982 | Nakamura . | |
| 4,664,095 | 5/1987 | Takahashi . | |
| 4,797,088 | 1/1989 | Nakamura . | |
| 4,872,831 | 10/1989 | Fujimoto . | |
| 5,080,578 | 1/1992 | Josephs . | |
| 5,165,883 | 5/1992 | Van Bemmel . | |
| 5,338,185 | 8/1994 | Henderson et al. | 431/34 |
| 5,409,370 | 4/1995 | Henderson | 431/2 |

FOREIGN PATENT DOCUMENTS 1205018 9/1970 United Kingdom .

OTHER PUBLICATIONS

Richard W. Henderson and George R. Lightsey, "Kerosene Heater Fires: Type," *Five Marshals Bulletin* (87–5), pp. 8–10, Nov. 1987.

Richard W. Henderson and George R. Lightsey, "Kerosene Heater Fires: Barometric Type," *The National Fire and Arson Report,* vol. 6(1), pp. 2–4 (1988).

Richard W. Henderson,"Barometric Kerosene Heaters," *Fire and Arson Investigator* vol. 39(3), pp. 26–27 (1989).

John J. Lentini, "Gasoline and Kerosene Don't Mix–At Least, Not in Kerosene Heaters," *Fire Journal* vol. 83(4), pp. 13,86 (1989)(Jul. –Aug.).

Richard W. Henderson and George R. Lightsey, "An Anti–Flareup Device for Barometric Kerosene Heaters," *Fire and Arson Investigator,* vol. 45(2), 8(1994).

*Primary Examiner*—Carroll B. Dority
*Attorney, Agent, or Firm*—David Pressman

[57] ABSTRACT

A safety device for preventing uncontrolled burning in wick-fed liquid fuel burners employs a solenoid (76) and a thermocouple (18) in combination with a microswitch (80). When excess fuel enters the fuel chamber (40), a float (30) is urged upward, which forces a pin (28) upward, causing a microswitch (80) to open, thereby interrupting the electrical communication between the solenoid and thermocouple. As a result, a spring (24) can act to force an arm (14) upward, actuating the automatic wick extinguishing unit (42). Also, the mechanism prevents re-ignition of the wick (54) until the excess fuel is removed from the fuel chamber. When the fuel in the fuel chamber exceeds a predetermined level, a warning gauge needle (84) is deflected, alerting the user of the liquid fuel burner to a dangerous condition.

16 Claims, 2 Drawing Sheets

SAFETY SHUT-OFF DEVICE FOR LIQUID FUEL BURNERS

BACKGROUND—CROSS-REFERENCE TO RELATED APPLICATIONS

This invention is an improvement over the inventions of several earlier applications, to-wit: Ser. No. 08/130,290, filed 1993 Oct. 4, now U.S. Pat. No. 5,338,185, granted 1994 Aug. 16, in the names of Richard W. Henderson and George R. Lightsey. Ser. No. 08/247,925, filed 1994 May 23 in the name of Richard W. Henderson. Ser. No. 08/297,048, filed 1994 Sep. 30, now U.S. Pat. No. 5,409,370, granted 1995 Apr. 25, in the name of Richard W. Henderson and Ser. No. 08/365,804, filed 1994 Dec. 29, in the name of Richard W. Henderson.

BACKGROUND—FIELD OF INVENTION

This invention relates to safety/devices, specifically to a mechanism for prevention of flareup in barometric-type wick-fed liquid fuel burners.

BACKGROUND—DISCUSSION OF PRIOR ART

In wick-fed liquid fuel burners, such as kerosene heaters, liquid fuel from a fuel chamber is supplied to a wick which is exposed to the oxygen of the atmosphere. Once the wick has been ignited, flame intensity and heat generation are controlled by positioning the wick with respect to a wick-receiving combustion chamber.

A common type of kerosene heater is the barometric style, in which gravity causes liquid fuel to be delivered to a horizontal fuel chamber from a vertically-oriented, removable tank inserted into the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which then allows air to enter the removable tank. As air enters the removable tank through the barometric valve, fuel in the removable tank flows into the fuel chamber until its level in the fuel chamber rises and covers the barometric valve in the removable tank cap, at which point fuel flow from the removable tank will cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, under certain conditions, fuel can overflow the fuel chamber.

When the overflowing fuel ignites, the result is an uncontrol led fire, or flareup.

The most common reason for fuel overflow is the inadvertent use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the rate of burning of the fuel. Should this process continue, the fuel chamber will overflow, since the removable tank holds about two to three liters more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering through compromise of the integrity of the removable tank.

There are safety devices that drop the wick down, thereby extinguishing the flame. If the burner tips over or experiences excessive vibration or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. Nos. 4,363,620, issued Dec. 14, 1982 to Nakamura; 4,872,831, issued Oct. 10, 1989 to Fujimoto; 4,797,088, issued Jan. 10, 1989 to Nakamura; and 5,165,883, issued Nov. 24, 1992 to Van Bemmel. However, not only do these devices fail to prevent flareup, they are ineffective in stopping flareup after its onset. In some cases, the safety devices require the use of external electrical power and electronic circuitry for actuation, and thus increase the cost and decrease the portability of the burners significantly, without rectifying the flareup problem.

It has been suggested in two publications ("Kerosene Heater Fires: Barometric Type," R. Henderson et al., *Fire Marshals Bulletin* (*National Fire Protection Association*), Vol. 87-5, p. 8 (1987); "Barometric Kerosene Heaters, " R. Henderson, *Fire and Arson Investigator* (International Association of Arson Investigators), Vol. 39, No. 3, p. 26 (1989) ) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented.

Also, it has been suggested that a float device be introduced into the fuel chamber to be used to activate the automatic wick extinguishing mechanism, and a sight gauge be present to show dangerous fuel levels in the fuel chamber. Introduction of such a float device requires that the fuel chamber be redesigned, as discussed above. Although some burners have sight gauges in the fuel chamber, the sight gauges are used only to indicate whether or not fuel is present, not when dangerous fuel levels are present in the fuel chamber.

In addition, it was proposed that a tank block-out device be installed, in which float in the reservoir would push on a pin that could move should the removable tank be withdrawn from the heater. Once again, such a device would require a redesigning of the fuel chamber and insertion of moving parts inside a somewhat restricted space. Also, this type of device would not prevent the entire contents of the removable tank from flowing into the fuel chamber, since it becomes operable only after the removable tank has been withdrawn.

U.S. Pat. No. 5,080,578, issued Jan. 14, 1992 to Josephs, claims that its device controls flareup in wick-fed liquid fuel burners by a ) cutting off the flow of fuel to the wick in response to excessive heat by blocking a fuel line, and b ) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick-fed liquid fuel burners in use—because these burners do not have fuel lines.

d) From the onset of flareup in wick-fed liquid fuel burners, fire is present outside the wick: therefore, retracting the wick does not affect the flareup process.

The device of the above-referenced related patent of Henderson and Lightsey/prevents flareup by activating a wick-extinguishing mechanism when the presence of excess fuel is detected in the fuel chamber. While this device has much merit, it requires the addition of a separate compartment below the level of the fuel chamber.

The device of the above-referenced related patent of Henderson prevents flareup by dropping the pin which holds open the barometric valve in the removable tank cap, thereby closing the valve and stopping fuel flow into the fuel chamber. Should the valve not close properly, or should some other mechanical malfunction occur, this device may not prevent flareup in some situations.

The device of the first above-referenced related patent application of Henderson, Ser. No. 08/247,925, prevents flareup by lifting the removable tank when excess fuel is present in the fuel chamber, thereby shutting off the barometric valve and stopping fuel flow from the removable tank. For this device to work, it is necessary to provide a spring to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the second above-referenced related patent application of Henderson, Ser. No. 08/365,804, prevents flareup by insulating the removable tank from heat from the combustion process, and by containing excess fuel lost from the removable tank in a containment system. Should excess fuel be lost from the removable tank and the fuel chamber become filled, fuel could leak out of seams or the wick adjuster mechanism, which may result in flareup.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tank, does not require the redesigning of the fuel chamber to increase its capacity, does not require the incorporation of a separate compartment, does not require outside electrical power or electronic circuitry, does not require the presence of flames outside the wick area for its actuation, and is applicable to kerosene heaters that do not have fuel lines.

Another object is to provide such a burner with a safety device which prevents fuel overflow from the fuel chamber, and therefore, prevents flareup.

In addition, the present burner does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

Figure 1:
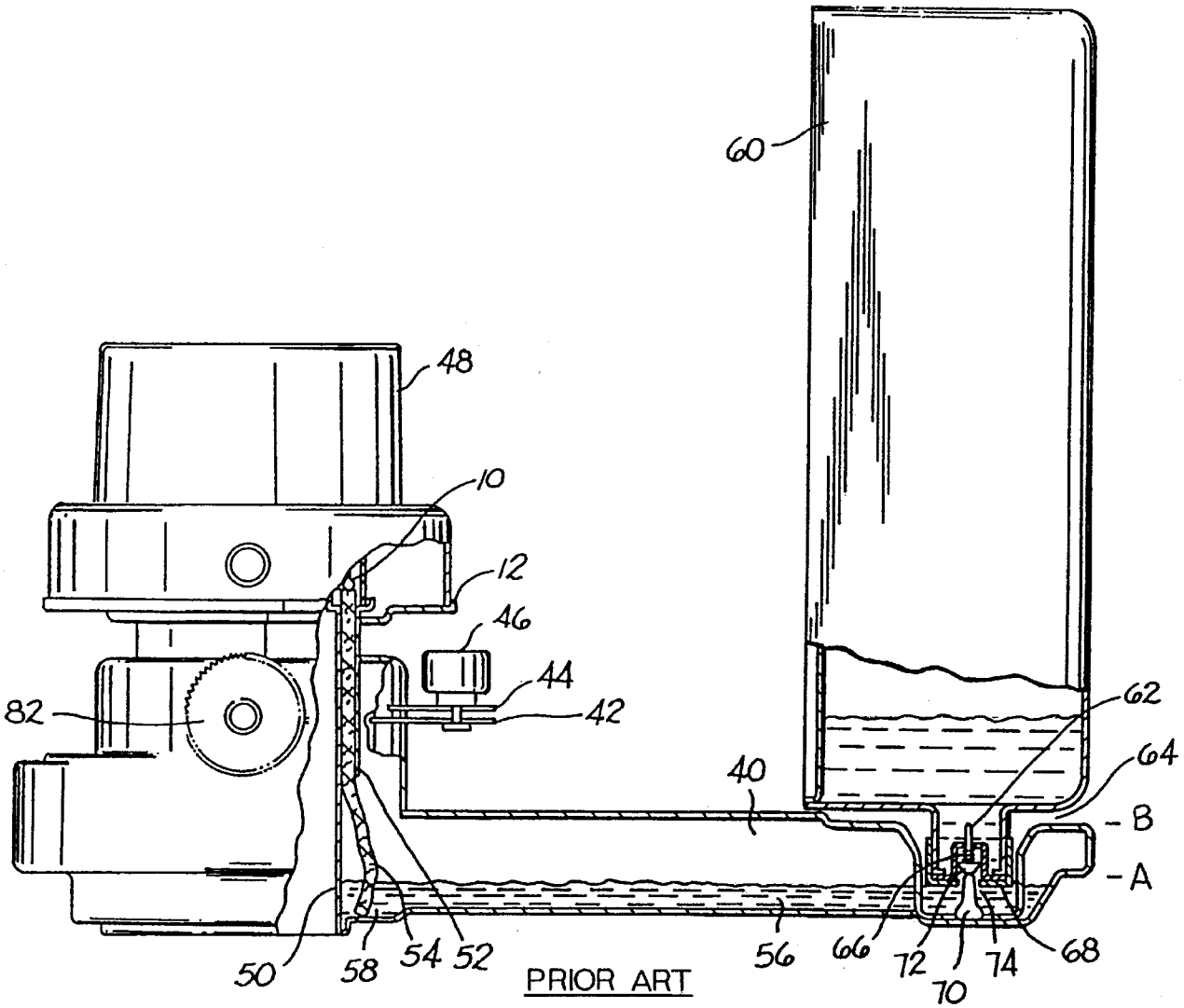
PRIOR ART FIG. 1
FIG. 1 is a side sectional view of a prior-art, wick-fed, barometric liquid fuel burner with an automatic wick extinguishing unit that can be activated by a vibration-sensing weight.

| DRAWING REFERENCE NUMERALS | |
|---|---|
| 10 | Flame |
| 12 | Combustion cylinder support member |
| 14 | Arm |
| 16 | Lever |
| 18 | Thermocouple |
| 20 | Pivot point |
| 22 | Support |
| 24 | Spring |
| 26 | Electrical conductors |
| 28 | Vertical arm |
| 30 | Float |
| 32 | Lever arm |
| 34 | Support |
| 36 | Pin guide |
| 38 | Pivot point |
| 40 | Fuel chamber |
| 42 | Automatic wick extinguishing unit |
| 44 | Fuel containment sump |
| 46 | Vibration-sensing weight |
| 48 | Combustion cylinder |
| 50 | Inner wick guide |
| 52 | Outer wick guide |
| 54 | Wick |
| 56 | Fuel |
| 58 | Fuel supply reservoir |
| 60 | Removable fuel tank |
| 62 | Plunger |
| 64 | Opening |
| 66 | Plunger spring |
| 68 | Tank cap |
| 70 | Pin |
| 72 | Plunger head |
| 74 | Orifice |
| 76 | Solenoid |
| 78 | Plate |
| 80 | Microswitch |
| 82 | Wick gear |
| 84 | Warning gauge needle |

-continued

| DRAWING REFERENCE NUMERALS | |
|---|---|
| 86 | Member |
| 88 | Member guide |
| 90 | Combustion cylinder ring |
| 92 | Pivot point |
| 94 | Pivot point |
| A | Normal fuel level |
| B | Flooded fuel level |

SUMMARY

In accordance with the present invention, a safety shutoff device for wick-fed, barometric liquid fuel burners provides a shutoff mechanism in the event that the fuel level in the fuel chamber exceeds a predetermined level. The device is designed such that movement of a lever is required to disengage an arm which keeps the wick shutoff mechanism actuated. After the lever is moved, the wick can be raised and lit. A thermocouple placed in the wick flame area energizes a solenoid, which then maintains the position of the lever so that when the lever is released, it remains in its deflected position. Should the level of the fuel in the fuel chamber exceed a predetermined level, a float is urged upward, causing a pin to rise, which opens a switch in the thermocouple/solenoid circuit, thereby releasing the lever and allowing the arm to actuate the wick shutoff mechanism.

In addition, a warning gauge provides a visual indication when the burner is in an unsafe condition.

DESCRIPTION—CONVENTIONAL HEATER STRUCTURE—FIG. 1

FIG. 1 is a side sectional view of a conventional wick-fed, barometric liquid-fuel burner (as described supra) that operates by burning a liquid fuel, such as kerosene. The burner is a wick-fed type with a combustion cylinder 48 and is constructed in a manner widely known in the art. One manufacturer of the burner of FIG. 1 is Toyotomi of Japan, and such manufacturer sells such burners under the trademark Envirotemp by Kero-Sun.

In normal operation fuel is delivered from a removable fuel tank 60 to a horizontal fuel chamber 40 through an orifice 74 in a tank cap 68 on tank 60. Tank 60 is held in a vertical position by a tank guide (not shown) in accordance with the common practice of the industry. Cap 68, which is attached to the neck of tank 60, is inserted into a mating well, or sump, in the top surface of chamber 40, also the common practice in the industry. A pin 70, which is located in the sump, pushes against a plunger head 72 on a plunger 62, thereby/compressing a spring 66. When tank 60 is lifted, spring 66 forces plunger head 72 downward, closing orifice 74.

When the fuel level in chamber 40 drops below level A due to fuel consumption by flame 10 on wick 54, air will bubble into tank 60 through orifice 74 in tank cap 68, and fuel (e.g., kerosene) will flow from tank 60 into chamber 40 until the level in chamber 40 rises back to level A. A partial vacuum above the fuel in tank 60 maintains the fuel in tank 60 above level A until all of the fuel has been discharged from tank 60. Fuel 56, which is in fluid communication with wick 54 via wick fuel supply reservoir 58, migrates by capillary action up the wick and is burned in flame 10 inside combustion cylinder 48. Cylinder 48 generally consists of several metal rings, including combustion cylinder ring 90, which is seated on combustion cylinder support member 12. Cylinder 48 provides a surface for the burning of the fuel, and radiates heat and some light. Flame 10 is seen through an outer glass cylinder (not shown) as a red glow above wick 54 in cylinder 48.

Wick 54, cylindrical in shape and shown in a partial cross-sectional view, can be moved up or down between inner wick guide 50 and outer wick guide 52 by rotating a wick gear 82. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 68 is cylindrical in shape, and is threaded to allow attachment to tank 60.

The fuel burner has an automatic wick extinguishing unit 42, which includes a vibration-sensing weight 46. If the burner is tilted or vibrated excessively, this could spill the fuel and create a fire. To prevent this, unit 42 senses the vibration, and disengages wick gear 82, which lowers wick 54, extinguishing the flame, or actuates any other wick extinguishing mechanism (not shown).

OPERATION AND DANGER OF FLAREUP WITH CONVENTIONAL BURNER—FIG. 1

If the partial vacuum in tank 60 is lost, the barometric system described earlier no longer regulates fuel flow from tank 60. The partial vacuum may be lost by compromise of the integrity of tank 60, or by the presence of a high vapor pressure fuel in tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two to three liters greater than that of chamber 40, chamber 40 will not be able to contain all of the fuel from tank 60, if any significant amount of fuel is present in tank 60. As a result, fuel fills chamber 40 and then overflows via opening 64 between tank 60 and the top of chamber 40. The fuel spreads over the fuel chamber's surface and to other areas in the burner. The flooded fuel will ignite because the vapors from the leaked fuel are drawn by air movement toward the wick flame in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup.

The flareup incidents involving high-volatility fuels do not occur immediately after the burners are lit, but rather after an induction period of one or more hours. There is a delay because these burners are utilized for heating purposes at cooler ambient temperatures. At such temperatures even the high-volatility fuels have vapor pressures low enough that the partial vacuum above the liquid in the removable tank is adequate to maintain the column of fuel in the tank, which requires a pressure differential of only 3 KiloPascals (0.4 psi) for the 36 cm (14 in) height typical of removable tanks.

For example, at 21° C. (70° F.) the vapor pressure of the most volatile class of gasoline, Class E, is on the order of 69 kPa (10 psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve.

The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from the removable tank as fuel is consumed by the wick.

Unless the burner is in a very low temperature environment, the temperature of the removable tank will typically exceed 38° C. (100° F.) during operation of the burner. The removable tank achieves such temperatures due to its proximity, about 13 cm (5 in), to the combustion process, which reaches temperatures in excess of 850° C. (1600° F.).

The typical flareup scenario involving a high-volatility fuel is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, and the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (approximately 2 liters ), the fuel chamber fills and overflows. The vapors from the spilled fuel ignite and flareup ensues.

With the exception of the above-referenced Henderson and Lightsey device, and the Henderson tank-lift, pin-drop, and insulation/containment devices, prior-art safety devices do not prevent flareup, but rather detect evidence that flareup has begun, and then trigger an automatic wick extinguishing unlit, which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device is designed to extinguish the flame on the wick prior to flareup. However, it requires the addition of an overflow compartment below the level of the fuel chamber. The Henderson tank-lift and pin-drop devices are designed to shut off fuel flow from the removable tank to the fuel chamber by separating the removable tank from the pin that opens the barometric device in the cap on the removable tank cap. However, these Henderson devices have in common the feature that should they not operate properly to shut the heater off, the fuel chamber may overflow and flareup may result. The Henderson insulation/containment device is designed to insulate the removable tank from the heat of the combustion process, and to contain any excess fuel delivered to the fuel chamber. However, should the temperature of the removable tank become elevated, such that excess fuel enters the fuel chamber, and should there be a leak in the containment system, or in the wick adjustment mechanism or other locations, flareup may result.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick drop mechanism, and cuts off fuel flow through a fuel line after the onset of flareup. Since the wick-fed barometric liquid fuel burners in common use do not utilize a fuel line, Josephs' device is not applicable to them. The Henderson and Lightsey, and three Henderson devices are designed to prevent flareup, but should they not function properly, flooding of the fuel chamber may occur and flareup may result.

DESCRIPTION OF INVENTIVE ANTI-FLAREUP DEVICE—FIG. 2

The present inventive device for wick-fed barometric liquid fuel burners solves the above drawbacks by providing a wick shutoff mechanism in response to the presence of excess fuel in the fuel chamber, and additionally, a warning gauge to alert the user should there be a dangerous condition in the burner. Shown in FIG. 2, it includes the following conventional elements: a removable tank 60 with a tank cap 68 which houses a spring-loaded plunger 62 functioning as a barometric valve in the usual fashion of the industry, a fuel chamber 40, a wick 54, a wick gear 82, a combustion cylinder 48, a vibration-sensing weight 46, and an automatic wick extinguishing unit 42.

Figure 2:
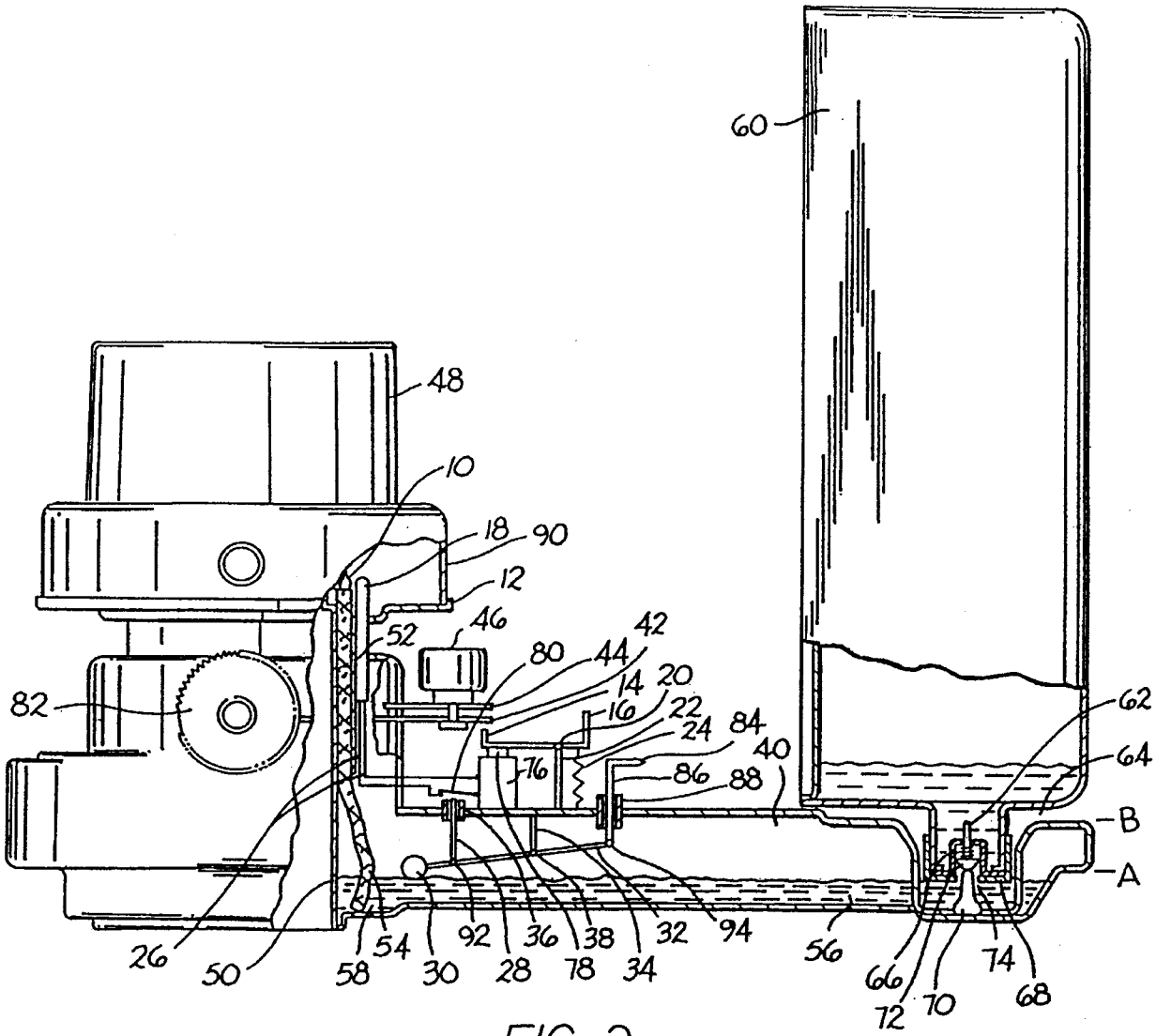
FIG. 2 is a side sectional view of a wick-fed, barometric liquid fuel burner with an anti-flareup safety device in accordance with the preferred embodiment of the present invention.

In addition, the burner of FIG. 2 includes additional elements which constitute a preferred embodiment of the present inventive anti-flareup safety device.

A thermocouple 18, which is situated immediately adjacent to flame 10, is connected by electrical conductors 26 to a solenoid 76 via a single-pole, single-throw, momentary, normally conductive microswitch 80. An arm 14 moves in a rotating manner about a pivot point 20, which is secured to a convenient frame member by a support 22. Attached to pivot point 20 opposite arm 14 is a lever 16. A spring 24 connects lever 16 to a convenient frame member. A plate 78 is attached to arm 14 such that it aligns with solenoid 76.

A float 30, which is located in fuel chamber 40, is attached to a lever arm 32, which moves in a rotating fashion about pivot point 38, which is secured to a convenient frame member, such as chamber 40, by support 34. At the distal end of arm 32 is attached a member 86, which extends upward vertically through a guide 88 that penetrates the upper surface of chamber 40. A pin 28, which is attached to arm 32 near float 30 at pivot point 92, extends vertically upward through pin guide 36, which penetrates the upper surface of chamber 40. The upper end of pin 28 is in contact with microswitch 80. A warning gauge needle 84 is attached to the top of member 86, which is free to move in a vertical manner through member guide 88.

Thermocouple 18 is about 0.6 cm (0.25 in) in diameter and 5 cm (2 in) long, and may be composed of various bi-metal combinations, as long as its output potential at the operating temperature of flame 10 is at least 15 mV. Solenoid 76 is about 2.5 cm (1 in) by 3.8 cm (1.5 in), and may be any type that responds to a potential of about 15 mV. The types of thermocouples and solenoids commonly used in gas equipment are suitable for this application.

Microswitch 80 may be any switch that has a contact arm that can be displaced when float 30 moves upward.

Arm 14 is approximately 7.6 cm (3 in) long and 0.6 cm (0.25 in) in diameter. Lever 16 is about 5 cm (2 in) long and 0.6 cm (0.25 in) in diameter. Spring 24 is around 2.5 cm (1 in) long and 0.6 cm (0.25 in) in diameter, and has sufficient tension to cause arm 14 to actuate wick extinguishing unit 42.

Electrical conductors 26 preferably are made of copper wire, about 18 gauge, insulated with PTFE.

Float 30 may be any convenient shape, such as spherical, so long as it has sufficient displacement, about 8 $cm^3$ (0.5 $in^3$), to move pin 28 upward when excess fuel envelops float 30. Member 86 and pin 28 are preferably cylindrical, and are about 7.6 cm (3 in) long, and 0.5 cm (0.2 in) in diameter. Guide 36 and guide 88 are cylindrical, and are approximately 5 cm (2 in) long and 0.2 cm (0.1 in) in diameter. Lever arm 32 is about 7.6 cm (3 in) long and 0.6 cm (0.25 in) in diameter.

OPERATION OF INVENTIVE ANTI-FLAREUP DEVICE—FIG. 2

When the burner is not operating, and thermocouple 18 is cool, spring 24 provides tension such that lever 16 situated at its furthermost position to the right. Arm 14 will be at its most upward position, automatic wick extinguishing unit 42 will be activated, and wick 54 will be in the retracted, or off position. Also, microswitch 80 will be in a closed position, float 80 will be at its lowest position, and warning gauge needle 84 will not be deflected. Before wick 54 can be raised to its normal operating position, lever 16 must be moved such that arm 14 drops down and releases automatic wick extinguishing unit 42, at which point wick 54 can be raised through use of wick gear 82, and then ignited.

After ignition of the wick, the burner components begin to increase in temperature. Thermocouple 18, which is adjacent to flame 10, becomes hot during operation of the burner, producing an electrical potential, which is transmitted through wires 26 to solenoid 76 via microswitch 80. When the potential is sufficient, it will force enough current through to hold plate 78 and arm 14 in their down position, and lever 16 can be released.

Tests of a contemporary burner equipped with the present inventive safety device have shown that the wick flame will increase the temperature of thermocouple 18 to 850° C. (1600° F.), producing a voltage of about 15 mV, which energizes solenoid 76 sufficiently to hold plate 78 in its down position, and the burner will continue to operate.

If during operation fuel flows out of tank 60 in an uncontrolled manner, and excess fuel enters chamber 40, float 30 will be buoyed upward. In response, pin 28 will move upward through guide 36, causing microswitch 80 to move to the open position. As a result, plate 78 will no longer be retained by solenoid 76, which allows arm 14 to move upward in response to the tension at its distal end provided by spring 24. The upward movement of arm 14 causes it to contact and actuate automatic wick extinguishing unit 42, causing wick 54 to drop down, thereby extinguishing flame 10. The upward movement of float 30 causes the distal end of lever arm 32 to move downward, moving about pivot point 38. Concomitantly, member 86 will move downward through guide 88, causing needle 84 to deflect, thereby providing warning of the dangerous condition of the burner.

As long as the fuel that activated the device remains in the fuel chamber, the wick cannot be raised because the wick extinguishing unit will remain actuated. Also, for this reason the warning gauge needle will continue to be deflected to indicate the presence of a dangerous condition in the burner.

Although automatic wick extinguishing unit 42 is illustrated as a wick drop mechanism, other devices are known for extinguishing the wick flame. For example, a horizontal barrier shutoff can alternatively be used. The present device can be utilized to activate other automatic wick extinguishing mechanisms by a suitable additional mechanism (not shown).

ADVANTAGES

It is clear from the discussion above that the anti-flareup safety device is quite simple in construction and can be readily incorporated in wick-fed barometric liquid fuel burners. Yet it will prevent flareup by quickly shutting off the burner in the event that excess fuel enters the fuel chamber. This will be so even when high-volatility fuels such as gasoline are inadvertently introduced into the burner.

Also, the device includes a warning gauge needle to indicate danger when there is excess fuel in the fuel chamber, thereby alerting the user to the dangerous condition of the burner.

In addition, the device can be reset if the device is triggered accidentally, so long as dangerous fuel conditions do not exist.

The present device prevents the burning of fuel outside its intended site, that being at the wick, thereby saving fuel and reducing odor. Also, the device does not require any electrical power other than that generated by the thermocouple when heated by the flame in the burner.

Clearly, the device incorporates multiple safety features, which will make wick-fed, barometric liquid fuel burners safer to operate, and accordingly, will at the same time reduce the expensive lawsuits resulting from flareup incidents causing injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the tfuel scope of the invention should not be so limited since other modifications will become apparent to the skilled practitioner upon a study of the drawings, specification and following claims.

For example, the shapes and composition of the various parts of the safety device can be varied greatly, so long as their function is preserved. While the preferred composition of the various parts of the safety device and appurtenant components is metal, other materials may also be utilized, such as plastics, composites, etc. The float may be made of cork, or other low-density materials. Thus, while the pin, pin guide, lever arm, member, member guide, arm and lever are depicted as being cylindrical, clearly they can have other shapes, such as oval, square, rectangular, etc.

Also, the device may be connected to or used in combination with other safety devices. The warning gauge may be eliminated. The float may be spherical, or have other shapes, so long as it fits conveniently in the fuel chamber.

Thus the scope of the invention should be determined, not by the examples given, but by the appended claims and their legal equivalents.

What is claimed is:

1. An apparatus for preventing flareup in a liquid fuel burner of the type comprising (a) a removable liquid fuel tank, (b) a fuel chamber, (c) an automatic wick extinguishing unit, and (d) a combustion chamber having a wick, where said fuel chamber carries liquid fuel from said removable tank to said wick of said combustion chamber, comprising:

an electrical circuit for normally preventing operation of said automatic wick extinguishing unit; and means for causing said electrical circuit to allow said wick extinguishing unit to operate should fuel in said fuel chamber exceed a predetermined level, thereby actuating said automatic wick extinguishing unit.

2. An apparatus according to claim 1 wherein said electrical circuit comprises a thermocouple and a solenoid in electrical communication, said solenoid being arranged to operate said wick extinguishing unit.

3. An apparatus according to claim 2 wherein said thermocouple is located in said combustion chamber.

4. An apparatus according to claim 1 wherein said electrical circuit comprises a thermocouple and a solenoid, in electrical communication, and wherein said means comprises a switch positioned to be actuated in response to excess fuel in said fuel chamber.

5. An apparatus according to claim 1, further including means for providing a visual danger indication to alert the user of the dangerous condition of excess fuel in said fuel chamber.

6. The apparatus of claim 1 wherein said means is arranged to interrupt said electrical circuit in response to said fuel exceeding said predetermined level.

7. A method of preventing flare-up in a liquid fuel burner of the type comprising a liquid fuel removable tank, a fuel chamber, an automatic wick extinguishing unit, and a combustion chamber having a wick, where said fuel chamber carries liquid fuel from said removable tank to said wick of said combustion chamber, comprising the steps of:

providing an electrical circuit for normally preventing operation of said automatic wick extinguishing unit;

detecting the presence of excess fuel in said fuel chamber; and causing said electrical circuit to allow said automatic wick extinguishing unit to operate in response to said presence of excess fuel in said fuel chamber.

8. The method of claim 7, further including providing a visual danger indication to alert the user of the dangerous condition of said excess fuel in said fuel chamber.

9. The method of claim 7 wherein said electrical circuit is interrupted in response to said presence of excess fuel in said fuel chamber.

10. The method of claim 7 wherein said electrical circuit comprises a thermocouple and a solenoid in electrical communication, said solenoid being arranged to operate said wick extinguishing unit.

11. An apparatus for preventing flareup in a liquid fuel burner of the type comprising (a) a removable liquid fuel tank, (b) a fuel chamber, (c) an automatic wick extinguishing unit, and (d) a combustion chamber having a wick, where said fuel chamber carries liquid fuel from said removable tank to said wick of said combustion chamber, comprising an electrical circuit for normally preventing operation of said automatic wick extinguishing unit, wherein said electrical circuit is configured to allow said wick extinguishing unit to operate should fuel in said fuel chamber exceed a predetermined level, thereby actuating said automatic wick extinguishing unit.

12. An apparatus according to claim 11 wherein said electrical circuit comprises a thermocouple and a solenoid in electrical communication, said solenoid being arranged to operate said wick extinguishing unit.

13. An apparatus according to claim 12 wherein said thermocouple is located in said combustion chamber.

14. An apparatus according to claim 11 wherein said electrical circuit comprises a thermocouple and a solenoid, in electrical communication, and wherein said means comprises a switch positioned to be actuated in response to excess fuel in said fuel chamber.

15. An apparatus according to claim 11, further including means for providing a visual danger indication to alert the user of the dangerous condition of excess fuel in said fuel chamber.

16. The apparatus of claim 11 wherein said means is arranged to interrupt said electrical circuit in response to said fuel exceeding said predetermined level.

* * * * *

UNITED STATES PATENT AND TRADEMARK OFFICE

CERTIFICATE OF CORRECTION

PATENT NO. : 5,551,865

DATED : September 3, 1996

INVENTOR(S) : R. W. Henderson et al

It is certified that error appears in the above-indentified patent and that said Letters Patent is hereby corrected as shown below:

Col. 2, line 21, change "flame. If" to —flame, if—.

Col. 2, line 45, change "(1989)" to —(1989))—.

Col. 2, line 46, delete ")".

Signed and Sealed this

Seventeenth Day of June, 1997

*Attest:*

*Attesting Officer*

BRUCE LEHMAN

*Commissioner of Patents and Trademarks*